United States Patent [101]

Morrison

[11] 4,052,766

[45] Oct. 11, 1977

[54] HAND SCRUBBER

[76] Inventor: Gordon MacRitchie Morrison, 45 Ballpark Lane, Hicksville, N.Y. 11801

[21] Appl. No.: 683,766

[22] Filed: May 6, 1976

[51] Int. Cl.[2] ..... A46B 13/04

[52] U.S. Cl. ..... 15/21 C

[58] Field of Search ..... 15/3, 3.1, 21 R, 21 B, 15/21 C, 21 D, 21 E, 36, 56, 75, 76, 97 R, 101; 4/166, 184

[56] References Cited

U.S. PATENT DOCUMENTS

| | | | |
|---|---|---|---|
| 1,366,306 | 1/1921 | Wick | 15/21 C |
| 1,837,389 | 12/1931 | Albany | 15/56 |
| 3,066,333 | 12/1962 | Butter | 15/56 X |
| 3,081,471 | 3/1963 | Newell | 15/21 D |
| 3,918,117 | 11/1975 | Plante | 15/21 D |

*Primary Examiner*—Edward L. Roberts
*Attorney, Agent, or Firm*—James P. Malone

[57] ABSTRACT

A hand scrubber having a hollow base member with a motor mounted therein. A drive dog is connected to the shaft of the motor. A hollow washing container is removably mounted in the base. The container has a driven dog meshing with the drive dog, and a brush connected to the shaft of the driven dog. The container has an aperture in its front so that a hand may be inserted into contact with the rotating brush.

5 Claims, 2 Drawing Figures

HAND SCRUBBER

This invention relates to hand scrubbing means and more particularly to a small portable hand scrubber which does not require any plumbing.

Workers with machinery, such as automobile mechanics and other service men and machinists, as well as painters and industrial workers, get their hands very dirty and impregnated with black grease and other foreign materials difficult to remove. It is especially hard to remove dirt, grime, grease and paint from under the finger nails.

Therefore, there is a need for a small, portable, inexpensive hand scrubber which may be moved around and does not require any plumbing.

The purpose of this invention is to make the cleaning of very soiled human hands easier and less time consuming. This is accomplished by inserting the hand in an especially designed container or tub which contains a suitable soap and water mixture. The tub contains a driven brush which along with highly agitated water cleans the entire hand.

The unit comprises two basic parts, the power pack base and the tub assembly.

The power pack base is a plastic housing shaped in such a manner as to form a shallow receptacle for the tub assembly. Mounted in a plastic housing is an electrical motor of sufficient power to drive a brush against mild hand pressure. The power pack also contains the electrical controls to stop, start, and speed up the motor. The electrical motor shaft protrudes through the housing and has a typical drive dog at the end of the shaft. This drive dog will mesh with the driven dog for the brush mounted in the tub when the tub is placed onto the power pack.

The tub assembly is an especially designed enclosure which houses the brush. It is formed so that when placed on the power pack base assembly, the brush dog engages the power dog on the power pack. The container or tub is preferably made of clear plastic with an aperture in the front. The aperture has a small spring loaded hole in it so when the hand is pushed through the hole, the spring will fit around the forearm to form a water tight seal. The driven dog has a conventional shaft seal to prevent water leakage. The brush is mounted on the driven dog shaft with a snap on/off connection. The tub also has a handle for easy handling.

In operation, the container or tub assembly is lifted off the power pack. A quantity of soap and water solution is placed into the container or tub. The tub is now placed back onto the power pack base. The hand is inserted through the aperture and the machine is turned on. As the brush rotates, the soap and water is highly agitated and the hand and fingers are manipulated on the rotating brush to clean all portions of the hand. The machine is turned off and dirty water is poured out of the aperture. This operation can be repeated if necessary.

The brush may be detachable to add other types of attachments, such as for massages, etc.

Accordingly, a principal object of the invention is to provide new and improved hand scrubbing means.

Another object of the invention is to provide new and improved portable, inexpensive hand scrubbing means which does not require any plumbing.

Another object of the invention is to provide new and improved hand scrubbing means comprising a hollow base member, a motor mounted in said base member, a drive dog connected to the shaft of said motor, a hollow container removably mounted in said base, said container having a driven dog meshing with said drive dog, a brush connected to the shaft of said driven dog for rotation, said container having an aperture in its front so that a hand may be inserted into contact with said brush.

These and other objects of the invention will be apparent from the following specification and drawings of which:

Figure 1:
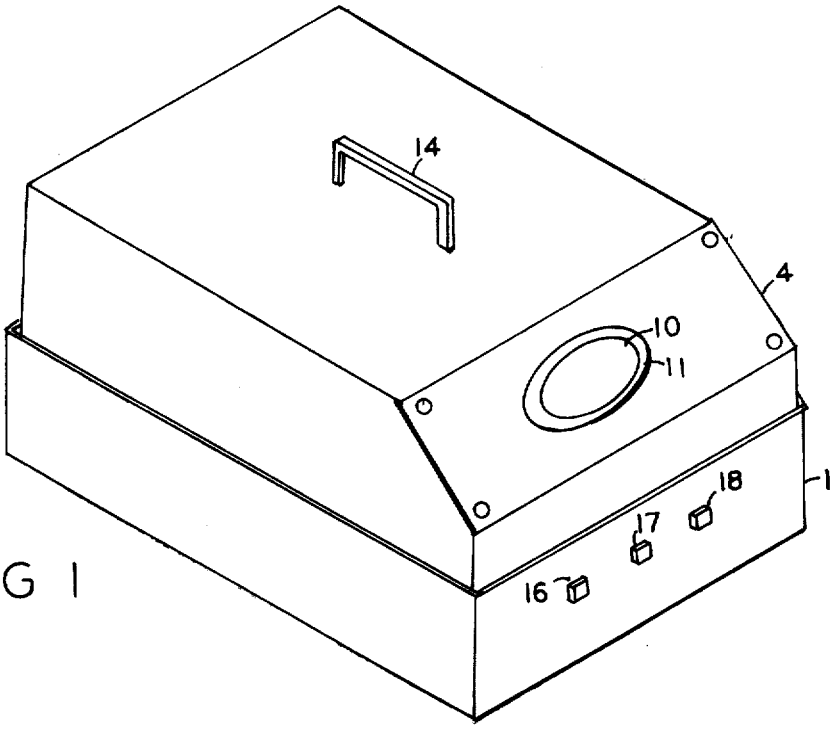
FIG. 1 is a perspective view of an embodiment of the invention.
Figure 2:
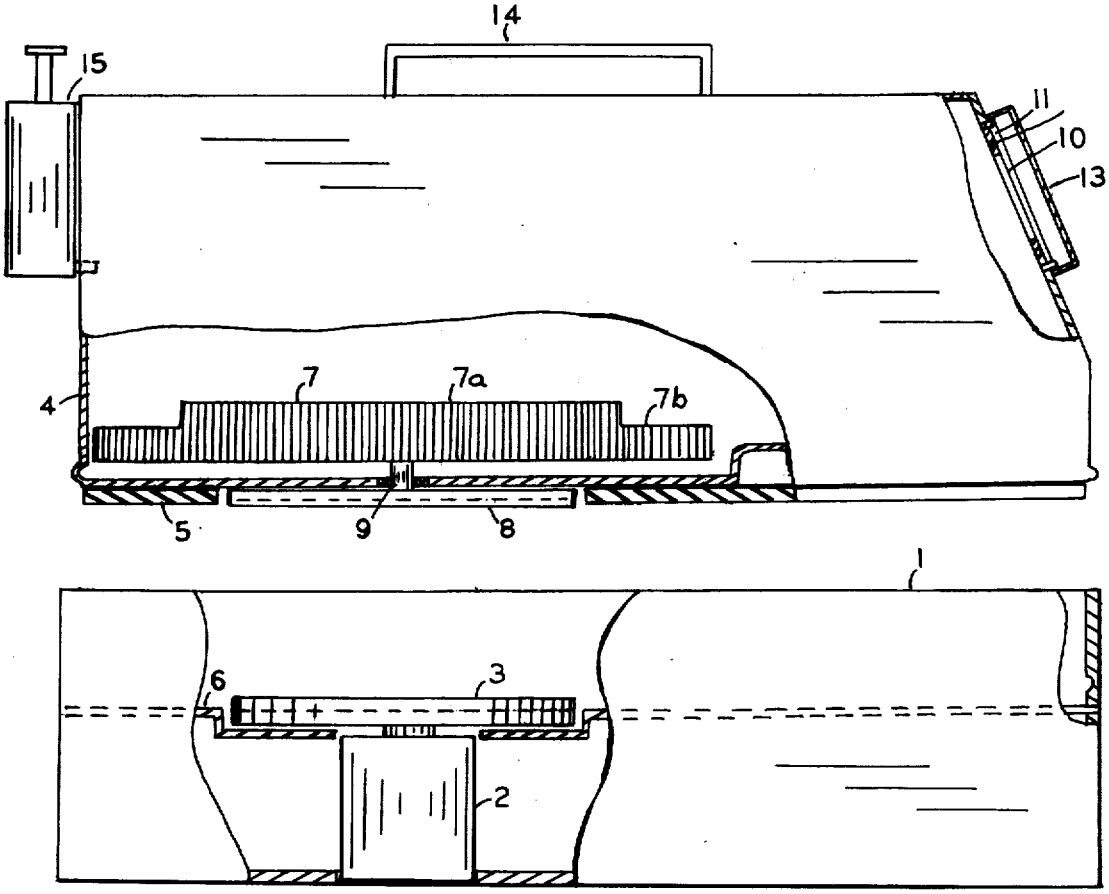
FIG. 2 is an exploded side view of the embodiment of FIG. 1, partially cut away and partly in section.

Referring to the figures, the invention generally comprises a hollow base member 1, which contains an electric motor 2. The motor may be a small fractional horsepower AC motor which may be plugged into an AC outlet or a DC motor may be used with batteries which may be mounted in the base member. On top of the motor is mounted a driving dog 3.

A hollow container or enclosed tub 4, is adapted to be mounted in the base power pack 1. When so mounted, the bottom of the container 4, which preferably has a resilient or rubber layer 5, rests on a shelf 6, of the base member 1. The container has a rotatably mounted brush 7, the shaft of which is connected to a driven dog 8, which meshes with the driving dog 3, when the container is mounted in the base. The dogs may be conventional with nesting slots and projections. The shaft of the brush 7, has a conventional seal 9, so that water in the container 4, will not escape. The tub 4 preferably has locking tabs 4' which fit into corresponding notches 1' in base member 1.

The container 4, has an aperture 10, in its front panel and the aperture contains a resilient ring 11, for the purpose of providing a seal to the arm of the user when a hand is inserted into the container in contact with the brush 7. The resilient seal 11, may have a circular spring 12, mounted therein for enhancing the seal. The aperture preferably has a screw cap 13, for keeping foreign material out of the container when it is not in use. The container 4, also has a handle 14, to facilitate handling. A soap or detergent dispenser 15, is preferably mounted on the container 4. The container is made in any convenient size so that when the arm is inserted in the aperture 10, the hand will make good contact with the brush 7. The brush 7, is preferably constructed with a central portion *7a* of soft bristles and a peripheral portion *7b*, of stiffer bristles for use on the finger nails and other difficult spots.

The motor preferably has an on/off control 16. A slow speed selector 17, and a high speed selector 18. These controls may be conventional.

In operation, the container 4, may be lifted out and partially filled with water or a soap solution, through the aperture 10. Alternatively, the soap may be supplied from the dispenser 15. Assuming the motor is connected to a source of energy, the motor is turned on and the user inserts one hand into contact with the brush 7, until the hand is clean. The other hand is then washed in similar manner. The operation may be repeated with clean water as often as necessary. The container is easily and quickly emptied by pouring the water out through the aperture 10. The apparatus may be made larger with two hand apertures for cleaning both hands at once.

I claim:

1. Hand scrubbing means comprising a hollow base member, a motor mounted in said base member, a shaft driven by said motor, a drive dog connected to the shaft of said motor, a hollow container removably mounted in said base, said container having a driven dog meshing with said drive dog, a shaft driven by said driven dog, a brush mounted in said container and connected to the shaft of said driven dog for rotation, said container having a front surface having an aperture so that a hand may be inserted into contact with said brush, said container having no permanent connection with the base so that it is easily removable.

2. Apparatus as in claim 1, wherein the brush has a center portion of soft bristles and a peripheral portion of hard bristles.

3. Apparatus as in claim 2, having a soap dispenser connected to the container.

4. Apparatus as in claim 3, wherein said aperture in the container has a resilient ring member adapted to form a seal around the arm of the user to prevent the water from splashing out of the container.

5. Apparatus as in claim 4, wherein the ring member has a circular spring imbedded therein to enhance the sealing of the soft member on the arm of the user.

* * * * *